US010131497B2

(12) United States Patent
Lee et al.

(10) Patent No.: US 10,131,497 B2
(45) Date of Patent: Nov. 20, 2018

(54) APPARATUS FOR SUPPRESSING SLOSHING

(75) Inventors: Sooho Lee, Geoje-Si (KR); Byenghee Yun, Geoje-Si (KR); Byeongsoo Kim, Geoje-Si (KR); Sangeon Chun, Geoje-Si (KR); Jonghak Kim, Geoje-Si (KR); Young-Min Lee, Busan (KR); Jeongoh Hwang, Gimhae-Si (KR)

(73) Assignee: SAMSUNG HEAVY IND. CO., LTD., Seoul (KR)

( * ) Notice: Subject to any disclaimer, the term of this patent is extended or adjusted under 35 U.S.C. 154(b) by 0 days.

(21) Appl. No.: 14/234,736

(22) PCT Filed: Jul. 26, 2012

(86) PCT No.: PCT/KR2012/005949

§ 371 (c)(1),
(2), (4) Date: Jan. 24, 2014

(87) PCT Pub. No.: WO2013/015618

PCT Pub. Date: Jan. 31, 2013

(65) Prior Publication Data

US 2014/0144915 A1 May 29, 2014

(30) Foreign Application Priority Data

Jul. 26, 2011 (KR) ..... 10-2011-0074325
Dec. 30, 2011 (KR) ..... 10-2011-0146894
Jul. 20, 2012 (KR) ..... 10-2012-0079335

(51) Int. Cl.
*B65D 90/52* (2006.01)
*B63B 25/08* (2006.01)
*B65D 88/34* (2006.01)

(52) U.S. Cl.
CPC ..... *B65D 90/52* (2013.01); *B63B 25/08* (2013.01); *B65D 88/34* (2013.01);
(Continued)

(58) Field of Classification Search
CPC ..... B65D 88/36; B60K 2015/0772
(Continued)

(56) References Cited

U.S. PATENT DOCUMENTS 1,712,321 A 5/1929 Afonin
3,349,953 A * 10/1967 Conaway ..... 220/734
(Continued)

FOREIGN PATENT DOCUMENTS

CN 101883715 A 11/2010
JP 53-126515 A 11/1978
(Continued)

OTHER PUBLICATIONS

Extended European Search Report dated May 30, 2016, which issued in European Application No. 12818315.9.
(Continued)

*Primary Examiner* — Jeffrey Allen
(74) *Attorney, Agent, or Firm* — McDermott Will & Emery LLP

(57) ABSTRACT

There is provided an apparatus for suppressing sloshing. An apparatus for suppressing sloshing according to an embodiment of the present invention includes a plurality of buoyant blocks and connecting members connecting the buoyant blocks and can float on a liquid cargo in a liquid cargo storage tank, the buoyant block includes a buoyant body having buoyancy to float on liquid, a first foam member covering the buoyant body and absorbing the liquid, and a first cover covering the first foam member, and the first foam member has through-holes formed through the first foam member.

19 Claims, 23 Drawing Sheets

(52) U.S. Cl.
CPC .. *F17C 2221/033* (2013.01); *F17C 2221/035* (2013.01); *F17C 2223/0153* (2013.01); *F17C 2223/0161* (2013.01); *F17C 2223/033* (2013.01); *F17C 2260/016* (2013.01); *F17C 2270/0105* (2013.01)

(58) Field of Classification Search
USPC ..... 220/563, 562, 578, 216, 218, 734
See application file for complete search history.

(56) References Cited

U.S. PATENT DOCUMENTS

| | | | | |
|---|---|---|---|---|
| 3,366,266 | A | 1/1968 | Heartstedt | |
| 3,400,854 | A * | 9/1968 | Conaway et al. | 220/734 |
| 3,401,818 | A * | 9/1968 | Hagen | 220/216 |
| 3,687,329 | A * | 8/1972 | Baum | 220/216 |
| 3,784,050 | A * | 1/1974 | Pollack | 220/734 |
| 3,822,807 | A * | 7/1974 | MacDonald et al. | 220/88.1 |
| 4,013,190 | A * | 3/1977 | Wiggins et al. | 220/501 |
| 4,611,724 | A * | 9/1986 | Watkins et al. | 220/562 |
| 4,764,408 | A * | 8/1988 | Stedman et al. | 428/71 |
| 4,974,743 | A * | 12/1990 | Sasaki et al. | 220/694 |
| 5,031,795 | A * | 7/1991 | Kotera et al. | 220/563 |
| 5,312,012 | A * | 5/1994 | Zink | 220/563 |
| 5,398,840 | A * | 3/1995 | Luhman et al. | 220/563 |
| 5,890,618 | A * | 4/1999 | Spickelmire | 220/563 |
| 6,032,347 | A * | 3/2000 | Behr et al. | 29/419.1 |
| 6,062,417 | A * | 5/2000 | Evans | 220/563 |
| 6,220,287 | B1 * | 4/2001 | Wolf | 137/574 |
| 6,308,856 | B1 * | 10/2001 | Spickelmire | 220/563 |
| D469,846 | S * | 2/2003 | Spickelmire | D23/206 |
| D507,626 | S * | 7/2005 | Bambacigno | D23/206 |
| 6,966,401 | B2 * | 11/2005 | Kojima | 181/233 |
| 7,421,963 | B1 | 9/2008 | Victor | |
| 7,648,749 | B1 * | 1/2010 | Taylor | 428/98 |
| 8,708,190 | B2 * | 4/2014 | Chun | 220/734 |
| 2002/0063133 | A1 * | 5/2002 | Spickelmire et al. | 220/563 |
| 2004/0134916 | A1 * | 7/2004 | Bambacigno | 220/563 |
| 2004/0155044 | A1 * | 8/2004 | Wilson | 220/562 |
| 2005/0103793 | A1 * | 5/2005 | Glass, Jr. | 220/694 |
| 2009/0001085 | A1 * | 1/2009 | Bartz et al. | 220/563 |
| 2009/0078705 | A1 * | 3/2009 | Ramsay | B60K 15/077 220/562 |
| 2009/0314790 | A1 * | 12/2009 | Eenkhoorn | 220/723 |
| 2010/0281887 | A1 | 11/2010 | Ha | |
| 2014/0144915 | A1 * | 5/2014 | Lee et al. | 220/563 |

FOREIGN PATENT DOCUMENTS

| | | | |
|---|---|---|---|
| JP | 09-226683 | | 9/1997 |
| JP | 09-226683 | A | 9/1997 |
| JP | 2002-173083 | A | 6/2002 |
| JP | 2002-205793 | A | 7/2002 |
| JP | 2004-063497 | A | 2/2004 |
| JP | 2005-187019 | A | 7/2005 |
| JP | 2006-036217 | A | 2/2006 |
| JP | 2008-260585 | A | 10/2008 |
| JP | 2008-273566 | A | 11/2008 |
| JP | 2011-184087 | A | 9/2011 |
| JP | 2012-508673 | A | 4/2012 |
| KR | 20-0336358 | B1 | 12/2003 |
| KR | 20-0336358 | Y1 | 12/2003 |
| KR | 10-2009-0037635 | A | 4/2009 |
| KR | 10-2010-0056351 | A | 5/2010 |
| KR | 10-2010-00056351 | A | 5/2010 |
| KR | 10-2010-0056363 | A | 5/2010 |
| KR | 10-2011-0055871 | A | 5/2011 |
| KR | 10-2012-0061719 | A | 6/2012 |
| KR | 10-2012-0061726 | A | 6/2012 |
| WO | WO-98/12392 | A1 | 3/1998 |
| WO | WO-2010/058932 | A2 | 5/2010 |

OTHER PUBLICATIONS

Partial Supplementary European Search Report dated Jan. 7, 2016, which issued in European Application No. 12818315.9.

* cited by examiner

APPARATUS FOR SUPPRESSING SLOSHING

FIELD

The present invention relates to an apparatus for suppressing sloshing.

BACKGROUND

In general, various types of ships are being manufactured to carry liquid cargos on the sea. For example, in order to carry liquid cargos such as LNG (liquefied natural gas), LPG (liquefied petroleum gas), and crude oil, hulls are manufactured in accordance with the features of respective cargos and specific shapes of liquid cargo storage tanks are used to seal and keep the cargos at a low temperature or a high pressure in the hulls.

One of important load conditions in manufacturing the hulls and the liquid cargo storage tanks is sloshing, which means behavior of liquid which applies a strong shock to the inner walls of a storage space (that is, liquid cargo storage tank) when liquid cargos with a free surface rapidly shakes while continuously receiving kinetic energy from movement of a hull, and sloshing is considered in the early stage of manufacturing hulls and liquid cargo storage tanks.

As described above, the shapes of hulls and liquid cargo storage tanks have been designed to minimize sloshing by liquid cargos and sufficiently resist expected sloshing loads, and in this process, ship owners had to accept conditional sailing conditions that limit the load in order to avoid sloshing loads which are structurally difficult to resist. Nevertheless, various problems keep occurred in unexpected damage to liquid cargo storage tanks due to uncertainty of sloshing loads.

The sloshing was a common issue to be solved for the fuel tanks in the aerospace, aerial, and automobile fields, and unlike ships, it was more important for spaceships or airplanes to supply fuel well rather than to simply reinforce the structures of the fuel tanks due to rapid behavior of fluid which is generated by rapid motions such as 360 degrees rotation, so they have solved the sloshing in the way of controlling the flow of liquid cargos, for example, liquid fuel.

In order to prevent such sloshing, the applicant(s) of the present invention has proposed an apparatus for suppressing sloshing which includes a plurality of buoyant floats that float on the surface of liquid, a foam member having an open cell structure to absorb liquid and surrounding the floats, and connecting members connecting adjacent floats, in Korean Patent Registration No. 1043622.

In the apparatus for suppressing sloshing disclosed in Korean Patent Registration No. 1043622, an example that a buoyant block including the foam member surrounding the floats has a cubic shape is proposed.

Since the apparatus for suppressing sloshing disclosed in Korean Patent Registration No. 1043622 is configured to suppress sloshing due to movement of a liquid cargo by moving with the movement of the liquid cargo, on or slight adjacently over the surface of the liquid cargo, the buoyant block of the apparatus for suppressing sloshing continuously hits against the inside of a liquid cargo storage tank.

As described above, since the buoyant block of the apparatus for suppressing sloshing hits against the inside of a liquid cargo storage tank, the cover that covers the surface of the buoyant block, the foam member, and the inside of the liquid cargo storage tank is damaged.

Meanwhile, according to the apparatus for suppressing sloshing disclosed in Korean Patent Registration No. 1043622, when the inside of a liquid cargo storage tank is cooled or heated, transmission of cooling or heating gas to the bottom of the liquid cargo storage tank is reduced by the apparatus for suppressing sloshing. Accordingly, it takes a long time to cool or heat the inside of the liquid cargo storage tank.

The above information disclosed in this Background section is only for enhancement of understanding of the background of the invention and therefore it may contain information that does not form the prior art that is already known in this country to a person of ordinary skill in the art.

SUMMARY

The present invention has been made in an effort to provide an apparatus for suppressing sloshing which has the advantages of having a structure that can prevent damage to a buoyant block and the inner wall of a liquid cargo storage tank.

An exemplary embodiment of the present invention provides an apparatus for suppressing sloshing which can quickly cool or heat a liquid cargo storage tank.

An exemplary embodiment of the present invention provides an apparatus for suppressing sloshing that includes a plurality of buoyant blocks and connecting members connecting the buoyant blocks and can float on a liquid cargo in a liquid cargo storage tank, in which the buoyant block includes a buoyant body having buoyancy to float on liquid, a first foam member surrounding the buoyant body and absorbing the liquid, and a first cover covering the first foam member, and the first foam member has through-holes formed through the first foam member.

The through-holes may be formed through the first foam member, in any one direction of a z direction which is the prolonged up-down direction, an x direction perpendicular to the z direction, and a y direction perpendicular to the z direction and the x direction.

At least one or more through-holes may be formed, and the through-holes may be arranged in parallel.

At least one of the through-holes may be formed through the center of the first foam member.

The z direction may be perpendicular to the bottom of the buoyant block.

The buoyant body may have through-holes formed through the buoyant body in any one direction of the z direction, the x direction, and the y direction.

The through-holes formed through the buoyant body may communicate with the through-holes formed through the first foam member.

The connecting member may include: a first connection belt disposed on the buoyant block, across the surface of the buoyant block; and a fastening member connecting the first connection belt of the buoyant block with the first connection belt of another buoyant block adjacent to the buoyant block.

The first connection belts may be arranged in a cross on the top and the bottom of the buoyant block.

First connection rings may be formed at both ends of the first connection belt.

The first connection rings may be positioned at an edge of the buoyant block.

The fastening member may include a pair of unit fastening members bending such that both ends are inserted in a pair of adjacent first connection rings, and the pair of unit fastening members may be coupled to each other with both ends facing each other.

The apparatus may further include a cover member covering the fastening member to prevent contact between the fastening member and the liquid cargo storage tank.

The fastening member may include a rope passing through a pair of adjacent first connection ring and connecting the first connection rings.

The rope may be a single rope formed by braiding a plurality of pieces.

One end of the single rope may sequentially or alternately pass through adjacent second-row first connection rings of any one buoyant block and then pass through adjacent second-row first connection rings of another buoyant block.

One end of the single rope may sequentially or alternately pass through adjacent second-row first connection rings of any one buoyant block and adjacent second-row first connection rings of another buoyant block, and may be the fastened to the other end of the rope.

The rope may be fastened by tying one end and the other end.

The rope may be formed such that a plurality of first pieces between the second-row first connection rings of any one buoyant block and a plurality of second pieces between the second-row first connection rings of another buoyant block are fastened to each other.

The rope may be formed by braiding a plurality of first pieces between the second-row first connection rings of any one buoyant block with a plurality of second pieces between the second-row first connection rings of another buoyant block are fastened to each other.

The fastening member may be made of the same material as that of the first connection belt.

The fastening member may include a thread connecting the ends of a pair of adjacent first connection belt by sewing.

The fastening member may be formed in the shape of a circular ring.

The fastening member may be formed in the shape of a key ring composed of two overlapping rings.

The buoyant may be a structure containing a gas or is made of a foam material having a closed cell structure.

The buoyant block may be formed in the shape of a cuboid.

In at least one buoyant block of a plurality of buoyant blocks each having a side facing the inner wall of the liquid cargo storage tank, a shock-absorbing block may be coupled to the side facing the inner wall of the liquid cargo storage tank.

The inner wall may be a side or the top of the liquid cargo storage tank.

The shock-absorbing block may include a second foam member that can absorb the liquid, and a second connection belt fastened to the second foam member so that the second foam member is coupled to a side of the buoyant block by the fastening member.

The shock-absorbing block may further include a second cover surrounding the second foam member, and the second connection belt is fastened to the second cover.

One side of the second cover may have a shape corresponding to one side of the buoyant block.

The second connection belt may be arranged on the other side of the second cover, across the other side of the second cover.

Second connection rings may be formed at both ends of the second connection belt.

The other side of the second cover may convexly protrude opposite direction to the one side.

The second foam member may be formed by filling the second cover with a foam member composed of a plurality of particles or by covering a foam member that is a single unit with the second cover.

According to an exemplary embodiment of the present invention, since shock-absorbing blocks that can be detachably combined with the buoyant blocks of the apparatus for suppressing sloshing are provided, so it is possible to prevent damage of the buoyant blocks of the apparatus for suppressing sloshing.

According to an exemplary embodiment of the present invention, it is possible to easily replace the shock-absorbing blocks mounted on the apparatus for suppressing sloshing, so the apparatus for suppressing sloshing can be easily maintained.

According to an exemplary embodiment of the present invention, it is possible to prevent the liquid cargo storage tank from being damaged due to hitting of the liquid cargo storage tank and the buoyant blocks of the apparatus for suppressing sloshing.

The apparatus for suppressing sloshing according to an exemplary embodiment of the present invention allows the bottom of the liquid cargo storage tank to be rapidly cooled or heated, when the inside of the liquid cargo storage tank is cooled or heated.

Figure 1:
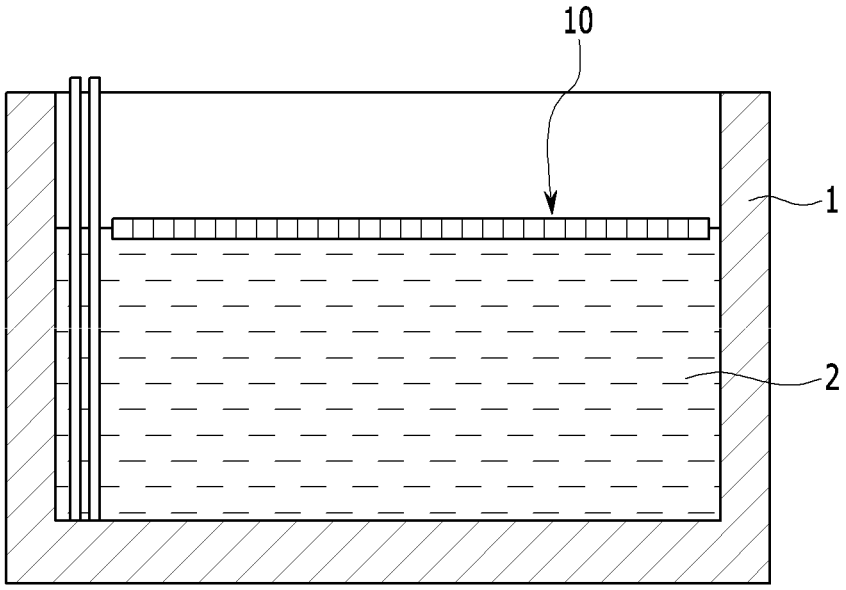
FIG. 1 is a cross-sectional view illustrating a state in which an apparatus for suppressing sloshing according to an exemplary embodiment of the present invention is installed in a liquid cargo storage tank.

Description of Reference Numerals Indicating Primary Elements in the Drawings

| | |
|---|---|
| 1 Liquid cargo storage tank | 2 Liquid cargo |
| 10 Apparatus for suppressing sloshing | 110 Buoyant block |
| 112 Buoyant body | 114 First foam member |
| 116 First cover | 122 First connection belt |
| 124 First connection ring | 130 Shock-absorbing block |
| 134 First foam member | 136 First cover |
| 138 Second connection belt | 139 Second connection ring |
| 150 Fastening member | 151 Rope |
| 152 Unit fastening member | 154 Connecting member |

DETAILED DESCRIPTION

Hereinafter, exemplary embodiments of the present invention will be described in detail with reference to the accompanying drawings so that those skilled in the art can easily achieve the present invention. As those skilled in the art would realize, the described embodiments may be modified in various different ways, all without departing from the spirit or scope of the present invention. The drawings and description are to be regarded as illustrative in nature and not restrictive. Like reference numerals designate like elements throughout the specification.

Figure 2:
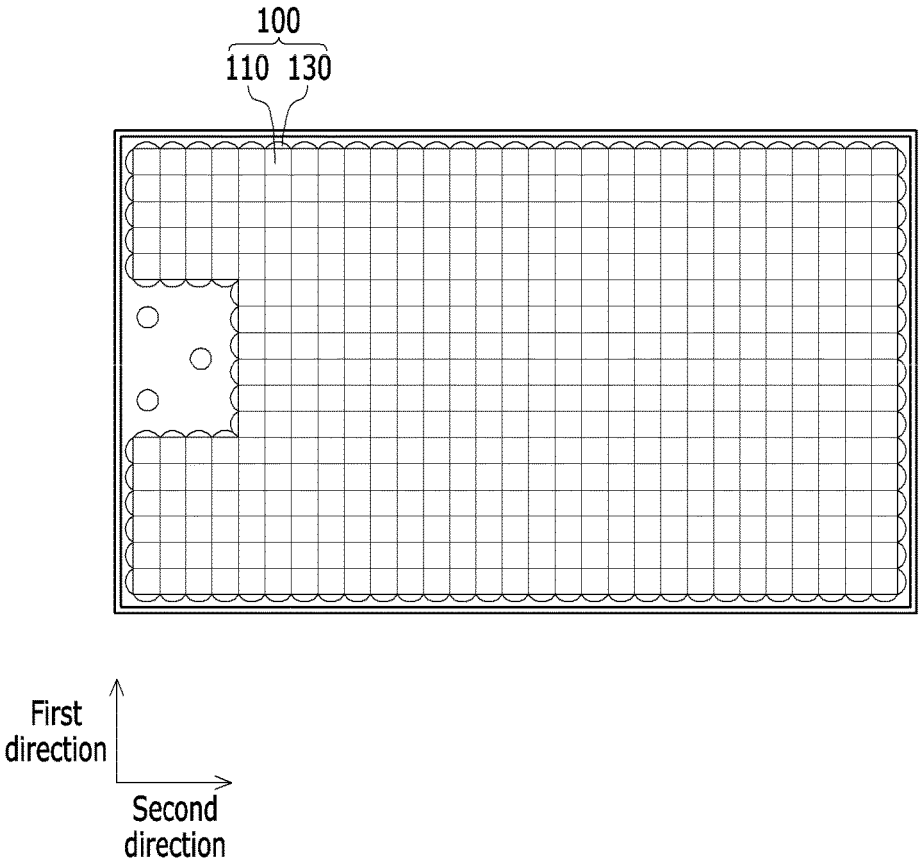
FIG. 2 is a top plan view illustrating a state in which the apparatus for suppressing sloshing according to an exemplary embodiment of the present invention is installed in the liquid cargo storage tank.
Figure 3:
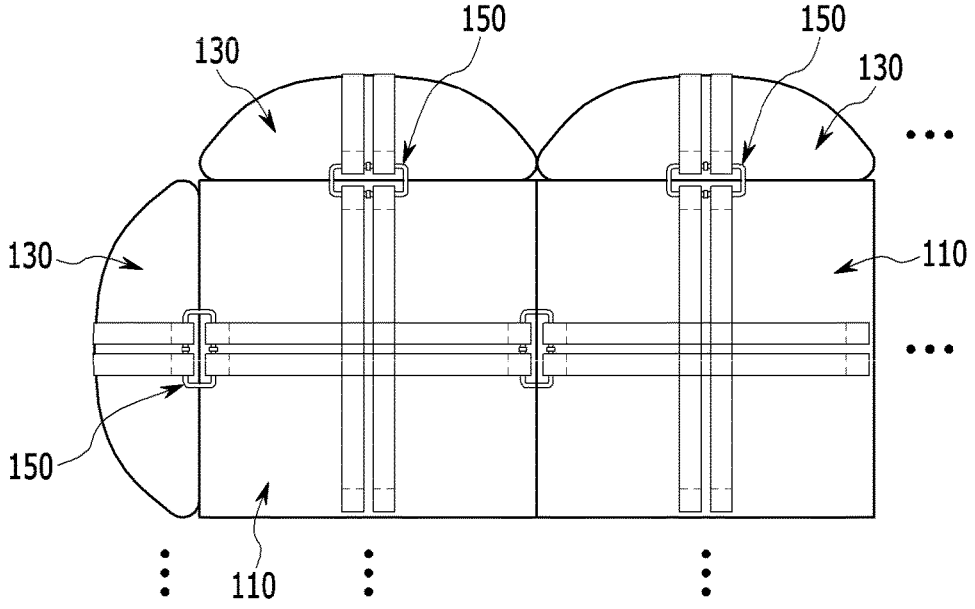
FIG. 3 is a top plan view illustrating a state in which buoyant blocks and shock-absorbing blocks are combined with each other in the apparatus for suppressing sloshing according to an exemplary embodiment of the present invention.

FIG. 1 is a cross-sectional view illustrating a state in which an apparatus for suppressing sloshing according to an exemplary embodiment of the present invention is installed in a liquid cargo storage tank. FIG. 2 is a top plan view illustrating a state in which the apparatus for suppressing sloshing according to an exemplary embodiment of the present invention is installed in the liquid cargo storage tank. FIG. 3 is a top plan view illustrating a state in which buoyant blocks and shock-absorbing blocks are combined with each other in the apparatus for suppressing sloshing according to an exemplary embodiment of the present invention.

An apparatus for suppressing sloshing according to the present exemplary embodiment, as illustrated in FIGS. 1 to 3, includes a plurality of buoyant blocks 110 disposed on a liquid cargo 2 stored in a liquid cargo storage tank 1, shock-absorbing blocks 130 coupled to the sides, which face the inner walls of the liquid cargo storage tank 1, of the sides of the buoyant blocks 110, and connecting members connecting the buoyant blocks 110 and the shock-absorbing blocks 130.

In an exemplary embodiment of the present invention, the buoyant blocks 110 are formed in the shape of a cube and may be unit bodies having buoyancy. The detailed configuration of the buoyant blocks 110 is described below.

Referring to FIG. 2, the buoyant blocks 110 are arranged in parallel in a first direction (horizontal in FIG. 2) and a second direction perpendicular to the first direction in a lattice and the whole buoyant blocks 110 make a rectangle to be able to cover the surface of the liquid cargo 2 stored in the liquid cargo storage tank 1.

The apparatus 10 for suppressing sloshing may have no buoyant block in a predetermined area to prevent the apparatus 10 for suppressing sloshing from hitting against a plurality of pipes 4 for transporting liquid that can be stored in the liquid cargo storage tank 1, for example, LNG or against the edges of the liquid cargo storage tank.

On the other hand, according to an exemplary embodiment of the present invention, as can be seen from FIG. 3, the connecting member for connecting a buoyant block 110 and a buoyant block 110 or a buoyant block 110 and a shock-absorbing block 130 includes first and second connection belts 122 and 138 formed on the surfaces of the buoyant blocks 110 and the shock-absorbing blocks 130 and a fastener 150 that fasten the belts to each other.

Although, in the present exemplary embodiment, the first and second connection belts 122 and 138 and the fastener 150 are exemplified as the connecting member for connecting the buoyant blocks 110 and the shock-absorbing blocks 130, the connecting member for connecting the buoyant blocks and the shock-absorbing blocks is not limited thereto and may include connecting members known in art, such as a Velcro tape or a zipper.

Further, according to an exemplary embodiment of the present invention, the outer sides of the buoyant blocks 110 connected in the shape of a rectangular face the inner sides of the liquid cargo storage tank 1, without the shock-absorbing blocks 130 disposed, and the shock-absorbing blocks 130 are disposed on the outer sides of the buoyant blocks 110. The shock-absorbing blocks 130 can be coupled to the buoyant blocks 110 by the connecting members for connecting the buoyant blocks 110.

According to an exemplary embodiment of the present invention, since the shock-absorbing blocks 130 are disposed on the outer sides of the buoyant blocks 110, so that the shock-absorbing blocks 130 protect the outer sides of the buoyant blocks 110.

The shock-absorbing blocks 130 are smaller in size than the buoyant blocks 110 and can be easily replaced, so that the shock-absorbing blocks 130 prevent the buoyant blocks 110 of the apparatus 10 for suppressing sloshing from being easily damaged in the liquid cargo storage tank 1. Further, the liquid cargo storage tank 1 is prevented from being damaged by the fastening member 130 connecting adjacent buoyant blocks 110.

The parts of the apparatus 10 for suppressing sloshing according to an exemplary embodiment of the present invention are described in more detail with reference to other figures. In this specification, in order to more clearly differentiate the constituent elements of the buoyant block and the shock-absorbing block, in the constituent elements that can be included in both of the buoyant block and the shock-absorbing block, the constituent block forming a portion of the buoyant block or disposed on the buoyant block is referred to as a "first" constituent element and the constituent element forming a portion of the shock-absorbing block or disposed on the shock-absorbing block is referred to as a "second" constituent block in the description of the apparatus for suppressing sloshing.

Figure 4:
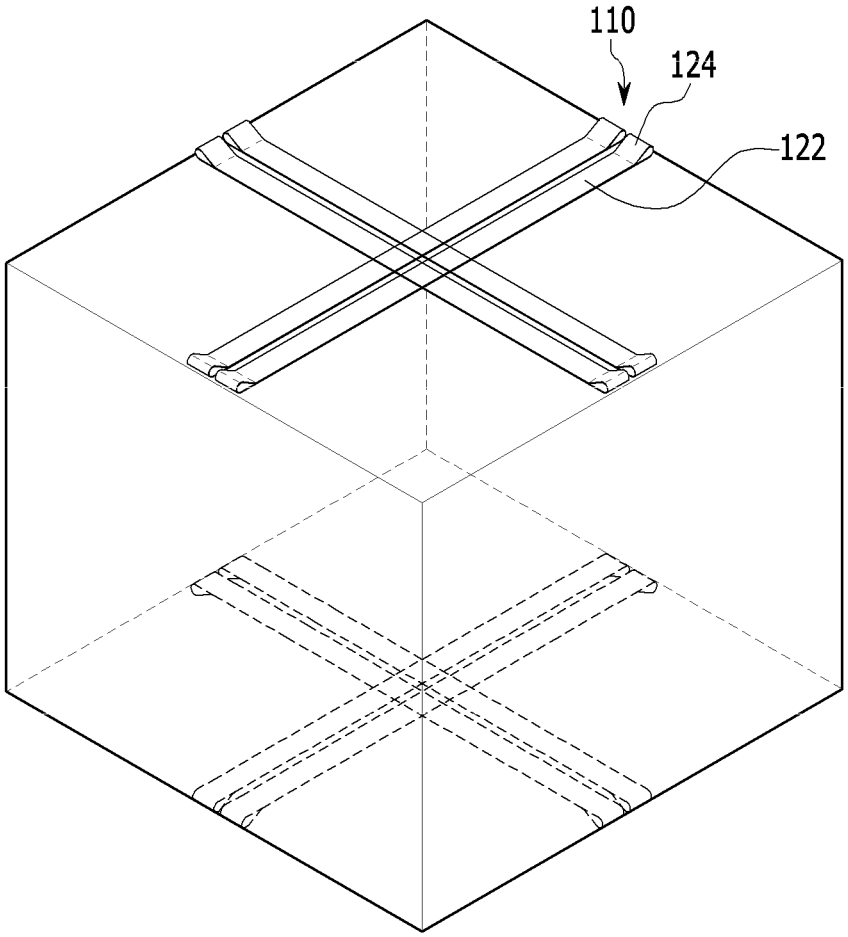
FIG. 4 is a perspective view of a buoyant block and a first connection belt combined with each other in the apparatus for suppressing sloshing according to an exemplary embodiment of the present invention.
Figure 5:
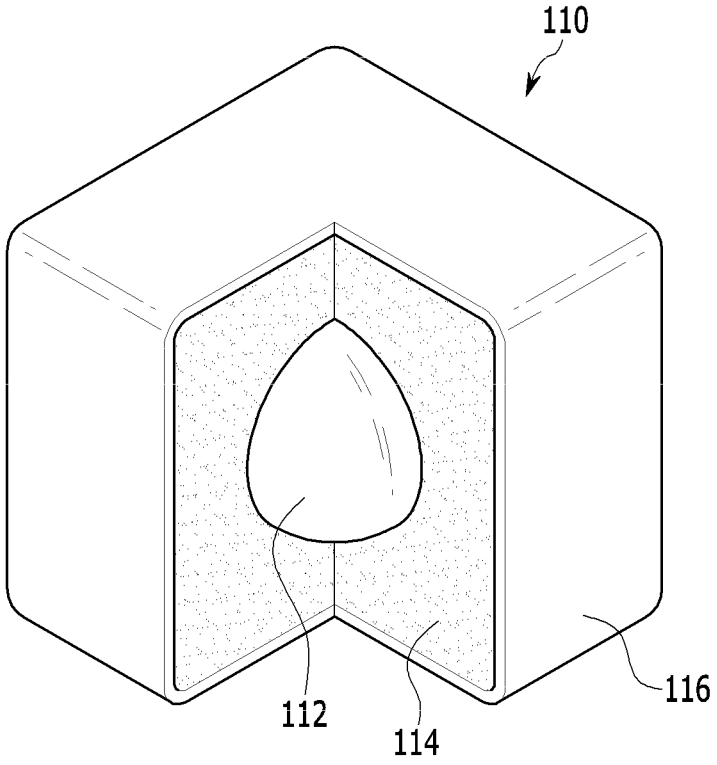
FIG. 5 is a partially cut-away perspective view of the buoyant block.

FIG. 4 is a perspective view of a buoyant block and a first connection belt combined with each other in the apparatus for suppressing sloshing according to an exemplary embodiment of the present invention. FIG. 5 is a partially cut-away perspective view of a buoyant block.

The buoyant block 110 is a part having buoyancy to float on the liquid cargo 2 stored in the liquid cargo storage tank 1, and in more detail, as illustrated in FIG. 5, the buoyant block 110 may be composed of a buoyant body 112 having buoyancy for floating on a liquid cargo, a first foam member 114 covering the buoyant body 112, and a first cover 116 covering the first foam member 114.

The buoyant block 110, as illustrated in FIGS. 4 and 5, may have the shape of a cube or a cuboid with a width, a length, and a height of 1.0 to 1.5 m and the size or the shape can be variously changed in accordance with the size of the inside of the liquid cargo storage tank 1.

The buoyant body 112, as illustrated in FIG. 5, may be a sphere, an ellipse, or other various shapes of structures.

The buoyant body 112 may have buoyancy for floating on the liquid cargo 2, and when the liquid cargo 2 is LNG, the buoyant body 112 may have a hollow structure with an airtight space to be capable of being filled with a gas that does not change into liquid even at a very low temperature.

The buoyant body 112 may have buoyancy by the structural characteristics or may have buoyancy by the characteristics of the material other than the structure.

The buoyant body 112 may be made of a material that is strong enough not to deform against buoyancy and may be made of aluminum or an aluminum alloy in order that the buoyant body 112 sufficiently discharges the duties even at a very low temperature due to the liquid cargo 2 such as LNG.

Further, the buoyant body 112 may be a structure containing a gas.

The buoyant body 112 may have a hollow structure with an airtight space to be capable of being filled with a gas that does not change into liquid even at a very low temperature, when the liquid cargo 2 is LNG.

The buoyant body 112 can have buoyancy by the structural characteristics, but may have buoyancy by the characteristic of the material other than the structure, and as another exemplary embodiment of the present invention, the buoyant body 112 may be made of a foam material having a closed cell structure.

The closed cell structure means a structure without a hole through which fluid can flows into/out of a structure made of a foam material, that is, a structure that the liquid cargo 2 cannot permeate. That is, the buoyant body 112 has not a hollow structure and the buoyant body 112 itself may be made of a foam material having a closed cell structure. Since the buoyant body 112 is made of a foam material having a closed cell, as described above, the liquid cargo 2 cannot permeate into the buoyant body 112, even if cracks are generated on the surface of the buoyant body 112 by a thermal load and a compression load, so the buoyant body can keep buoyancy stable.

For example, the buoyant body 112 may be made of a polymer including any one of phenol resin, melamine resin, and synthetic resin of them to be able to keep elastic even at a very low temperature at which a liquid cargo such as LNG maintains the liquid state.

The first foam member 114 may cover the outer side of the buoyant body 112 and the entire shape may be a cube, as illustrated in FIG. 5.

In this case, the first foam member 114 may have an open cell structure to be able to more effectively prevent sloshing by allowing the liquid cargo 2 to permeate the first foam member. The open cell structure is a structure with holes formed to communicate with the inside and the outside of the first foam member 114 and can maximize the surface area of the first foam member 114, so absorption of the liquid cargo can be accelerated.

Since the first foam member 114 is formed in an open cell structure and the liquid cargo 2 permeates into the first foam member 114, the buoyant blocks 110 float on the liquid cargo 2, partially sunken in the liquid cargo 2, and covers the free surface of the liquid cargo 2, so sloshing of the liquid cargo 2 in the liquid cargo storage tank 1 can be more effectively suppressed.

The first foam member 114 may be made of a polymer, for example, a polymer including any one of phenol resin, melamine resin, and synthetic resin of them which can keep elastic and can absorb the liquid cargo 2 even at a very low temperature at which the liquid cargo 2 such as LNG keeps the liquid state.

The first cover 116, as illustrated in FIG. 5, covers the first foam member 114, so the first cover 116 can prevent the first foam member 114 from breaking and prevent also the liquid cargo 2 from being contaminated with fragments of the first foam members 114 that is partially damaged.

The first cover 116 may be made of a material which can keep the durability even at a very low temperature, which is the same as that at the room temperature, and may be made of polyarylate fiber, for example.

The first connection belt 122, as illustrated in FIGS. 3 and 4, may be disposed on the buoyant block 110, across the surface of the buoyant block 110. In more detail, the first connection belt 122, as illustrated in FIG. 4, may be disposed on the top and the bottom of the buoyant block 110, passing the centers of the top and the bottom of the buoyant block 110.

The first connection belt 122 is not disposed simply at the end portions of the buoyant block 110 or in a limited area on the buoyant block 110, but as described above, disposed across the surface of the buoyant block 110, so the combination area between the buoyant block 110 and the first connection belt 122 is maximized. Accordingly, the load exerted in the interface between first connection belt 122 and the buoyant block 110 due to shaking of the buoyant block 110 can be uniformly distributed on the surface of the buoyant block 110, and as a result, the structural stability of the apparatus 10 for suppressing sloshing can be considerably improved.

The first connection belt 122 is made of the same material as that of the first cover 116 of the buoyant block 110 and can be attached to the first cover 116 of the buoyant block 110, for example, by sewing, or may be attached to the surface of the buoyant block 110 by an adhesive and the like.

In this case, the first connection belt 122, as illustrated in FIG. 4, may be provided in a pair such that the pair of first connection belts 122 cross each other and the pair of cross first connection belts 122 as illustrated in FIG. 4, may be disposed on the top and the bottom of the buoyant block 110, respectively.

As the first connection belts 122 are disposed across each other, as illustrate in FIG. 2, the buoyant blocks 110 arranged in a lattice can be effectively connected in the first direction and the second direction.

Further, the first connection belts 122 may be a pair of unit belts, as illustrated in FIG. 4, and the unit belts may be arranged in parallel at a predetermined distance from each other.

Since a pair of unit belts is arranged at a predetermined from each other, as described above, a space for easier coupling of the fastening member 150 can be provided. This is described in detail below with the description of the fastening member 150.

On the other hand, as illustrated in FIG. 4, first connection rings 124 may be formed at both ends of the first connection belt 122. As illustrated in FIG. 3, the adjacent buoyant blocks 110 can be connected by coupling the fastening members 150 to the adjacent first connection rings 124.

In this case, the first connection ring 124 is formed by bonding one end to the other end of the first connection belt 122 bent with one end facing the other end.

That is, as illustrated in FIG. 4, the first connection ring 124 can be formed at the end of the first connection belt 122 without using a specific additional member by bonding, for example, sewing one end to the other end of the first connection belt 122 folded with one end of the first connection belt 122 facing other end.

In an exemplary embodiment of the present invention, the unit body with the buoyant block and the first connection belt combined may be called a buoyant unit. The buoyant units can be connected by fastening members, and accordingly, the apparatus 10 for suppressing sloshing according to an exemplary embodiment of the present invention may be understood as being formed by connecting the buoyant units in a lattice with the fastening members 150.

Referring to FIGS. 6 to 9, the first foam member 114 according to an exemplary embodiment of the present invention has through-holes 111 and 113 formed through the first foam member 114.

Figure 6:
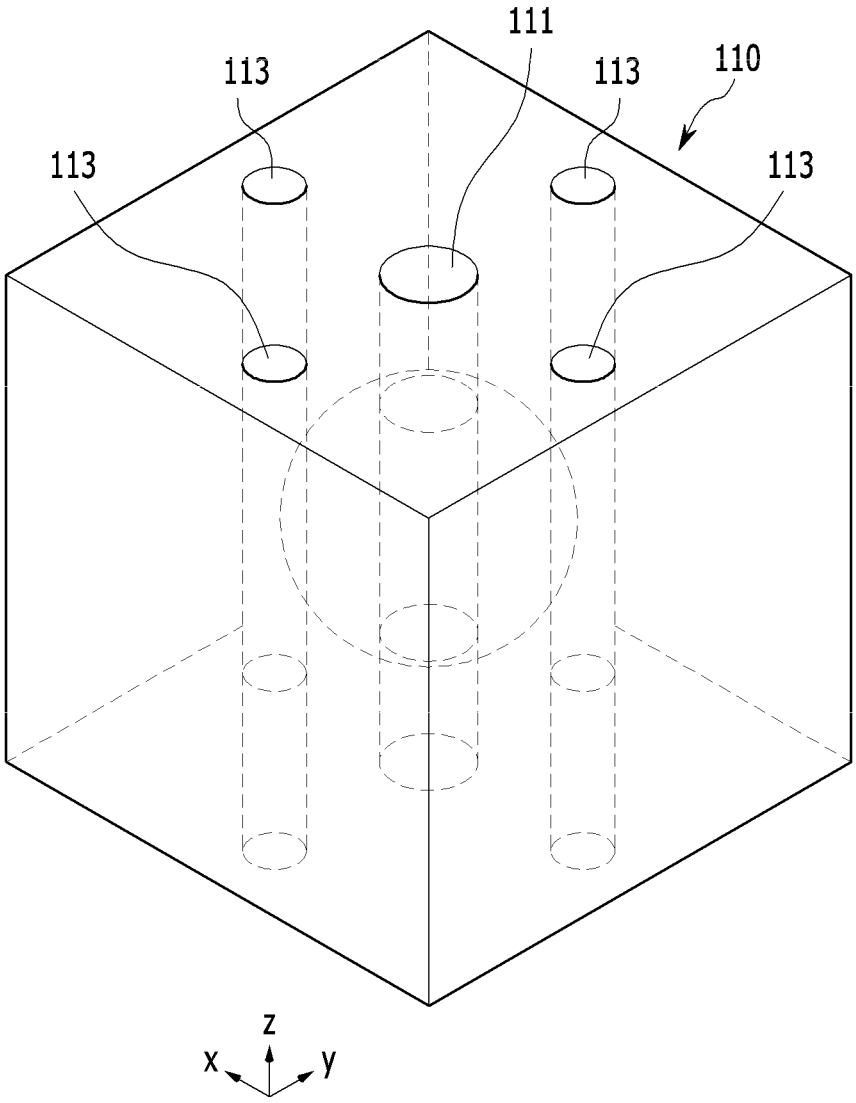
FIG. 6 is a perspective view of an example of a first foam member of the buoyant block in the apparatus for suppressing sloshing according to an exemplary embodiment of the present invention.

Referring to FIG. 6, the through-holes 111 and 113 may be formed through the first foam member 114 in the z direction, which is the up-down direction, in FIG. 6.

One or more through-holes 111 and 113 may be formed. A plurality of through-holes 111 and 113 may be arranged in parallel, as illustrated in FIG. 6.

Further, one of the through-holes may be formed through the center of the first foam member 114. The through-hole 111 formed through the center of the first foam member 114 may be aligned and communicate with a through-hole 112*a* formed in the buoyant body 112 to be described below.

Though not illustrated, the through-holes 111 and 113 may be arranged not in parallel, but off-center from each other.

The width and the number of the through-holes 111 and 113 that are formed in the first foam member 114 may be variously selected in accordance with the size and shape of the first foam member 114.

Figure 7:
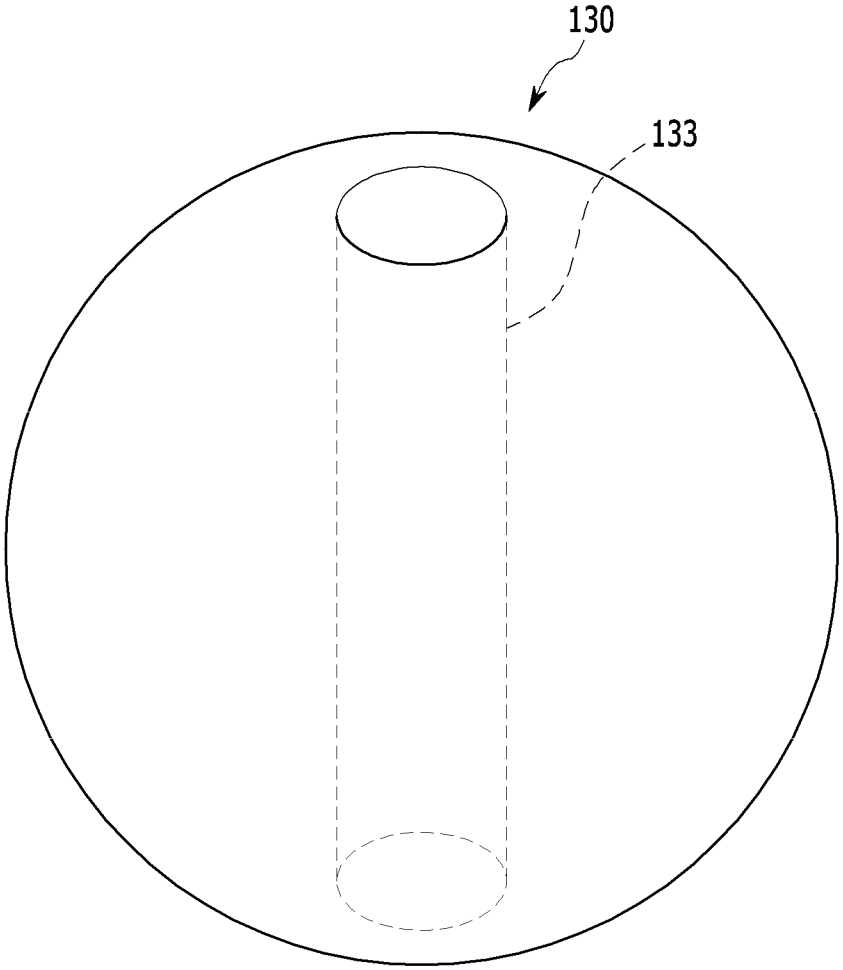
FIG. 7 is a perspective view of an example of a buoyant body of the buoyant block in the apparatus for suppressing sloshing according to an exemplary embodiment of the present invention.

According to an exemplary embodiment of the present invention as illustrated in FIG. 7 the through-hole 112*a* is formed in the up-down direction, that is, the z direction through the buoyant body 112.

The through-hole 112*a* may be formed through the center of the spherical buoyant body 112. As described above, the through-hole 112*a* formed in the buoyant body 112 may be aligned with the through-hole 111 formed in the first foam member 114.

As described above, as the through-holes are formed in the first foam member 114 and the buoyant body 112, a gas can more quickly spread, when a high-temperature gas is injected into the liquid cargo storage tank 1 to evaporate the liquid cargo in the liquid cargo storage tank 1 with the apparatus 10 for suppressing sloshing therein, or when a cooling gas is injected to cool the inside of the liquid cargo storage tank. More detailed description is provided below for this configuration.

Figure 8:
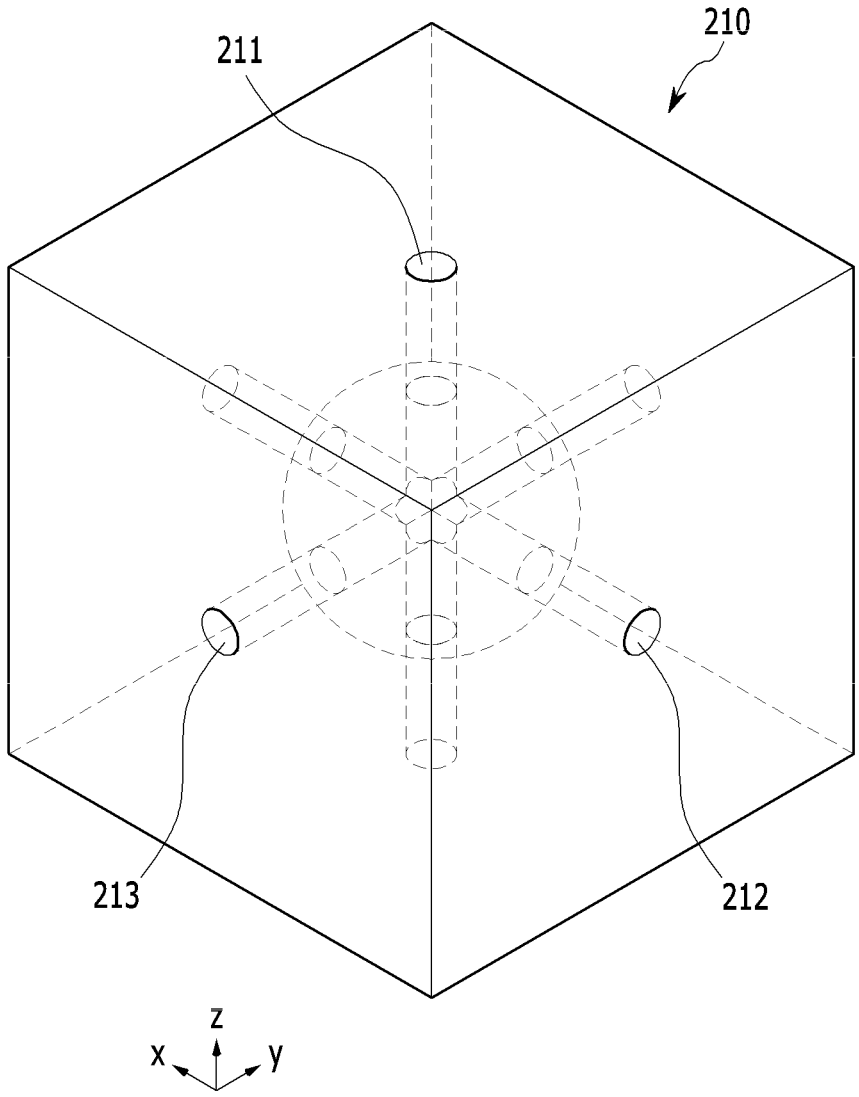
FIG. 8 is a perspective view of another example of a first foam member of the buoyant block in the apparatus for suppressing sloshing according to an exemplary embodiment of the present invention.

Further, referring to FIG. 8, as another example of the first foam member of the apparatus for suppressing sloshing according to an exemplary embodiment of the present invention, through-holes 211, 212, and 213 may be formed through the first foam member 114 in the z direction, which is the up-down direction, in FIG. 8, and in the x direction and the y direction which are perpendicular to the z direction.

The through-holes 211, 212, and 213 may be formed through the center of the first foam member 114. The through-holes 211, 212, and 213 formed through the center of the first foam member 114 may be aligned and communicate with the through-holes 231, 232, 233 (see FIG. 9) formed in the buoyant body 212 (see FIG. 9) to be described below.

Figure 9:
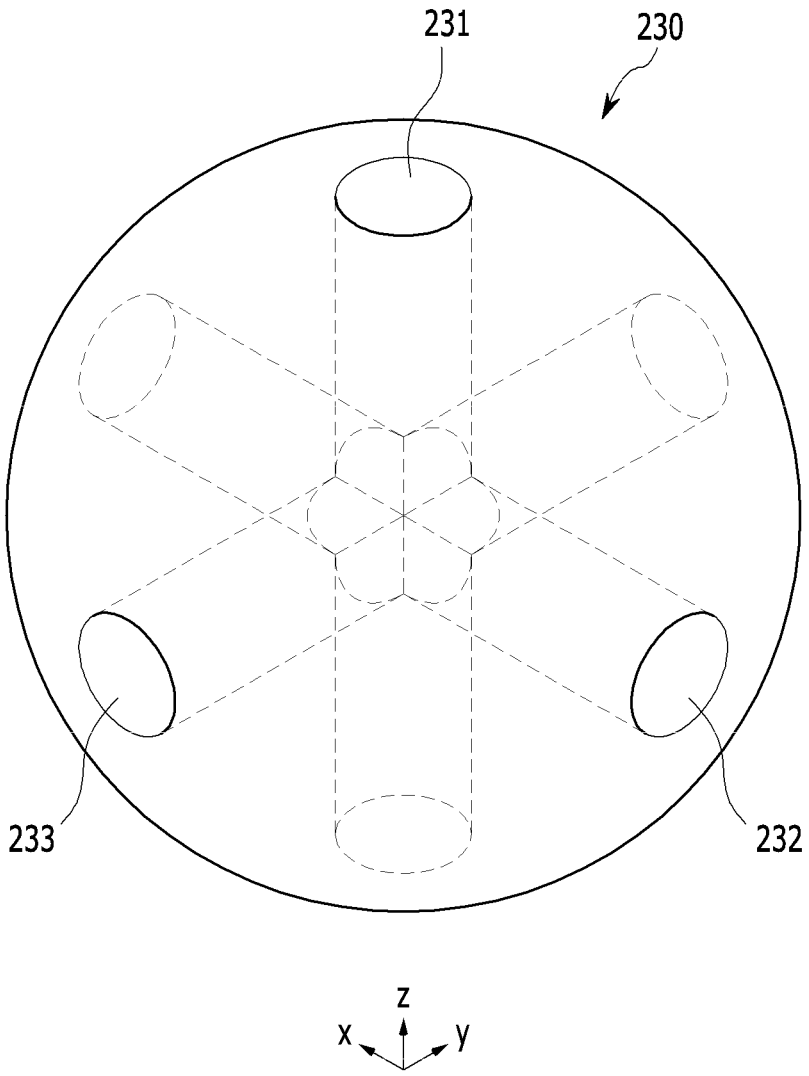
FIG. 9 is a perspective view of another example of a buoyant body of the buoyant block in the apparatus for suppressing sloshing according to an exemplary embodiment of the present invention.

A illustrated in FIG. 9, in another example of the buoyant body 212 of the apparatus for suppressing sloshing according to an exemplary embodiment of the present invention, the through-holes 231, 232, and 233 may be formed in the z direction, x direction, and y direction through the buoyant body.

The through-holes 231, 232, and 233 formed in the buoyant body 212 may be formed through the center of the spherical buoyant body 212. Accordingly, as illustrated in FIG. 9, the through-holes 231, 232, and 233 formed in the z direction, x direction, and y direction cross at the center of the buoyant body 212.

When the through-holes are formed, as described above, the through-holes 231, 232, and 233 formed in the buoyant body 212 may be aligned with the through-holes 211, 212, and 213 as illustrated in FIG. 8 formed in the first foam member 114 to communicate with the through-holes 211, 212, and 213.

As the through-holes 212, 213, 232, and 233 are formed in the first foam member and the buoyant body in the x direction and the y direction, when buoyant blocks and buoyant blocks are connected each other, the through-holes formed in the foam members of the buoyant blocks can communicate with each other.

The through-holes 112*a*, 231, 232, and 233 formed in the buoyant bodies 112 and 212 makes it easy to manufacture the buoyant body, when the buoyant body is made of a foamed material.

In more detail, when the buoyant bodies 112 and 212 are made of closed-cell-shaped foamed material, the buoyant bodies may be formed by putting polyethylene particles, which are a plurality of small particles, into a mold and then pressing and heating the polyethylene particles at a high temperature.

When a buoyant body is formed in the shape of a sphere, the surface is easily formed in a dense structure by the high temperature and the high pressure applied to the mold, but the inside of the sphere is lower in temperature and pressure than the surface of the buoyant body, so the inside may not be formed in a dense structure relatively to the surface or gaps may be generated between the polyethylene particles.

When the through-holes 112*a*, 231, 232, and 233 are formed through the buoyant bodies 112 and 212, as in an exemplary embodiment of the present invention, the inside of the buoyant bodies 112 and 212 can be formed uniformly at a high temperature and a high pressure, so the buoyant bodies with the dense insides can be formed.

Figure 10:
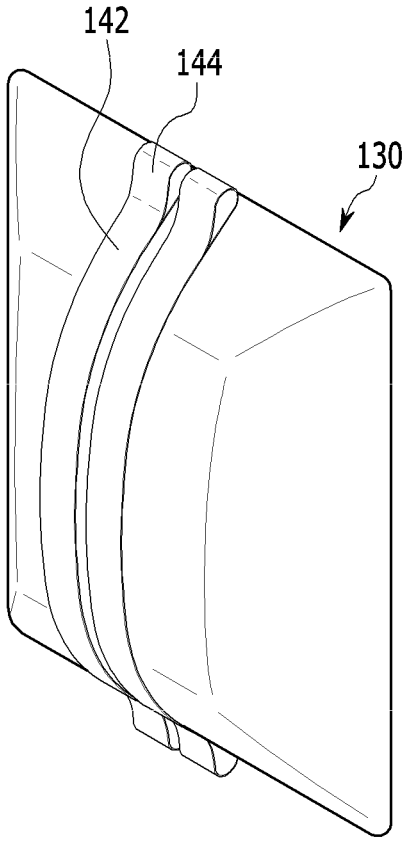
FIG. 10 is a perspective view of a shock-absorbing block and a second connection belt combined with each other in the apparatus for suppressing sloshing according to an exemplary embodiment of the present invention.
Figure 11:
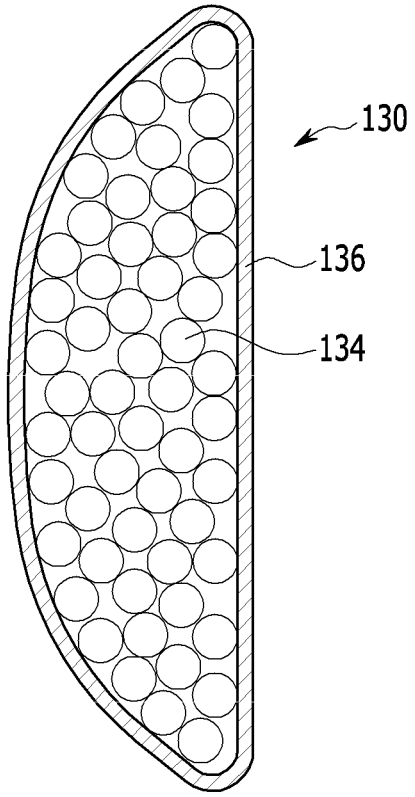
FIG. 11 is a cross-sectional view of the shock-absorbing block.
Figure 12:
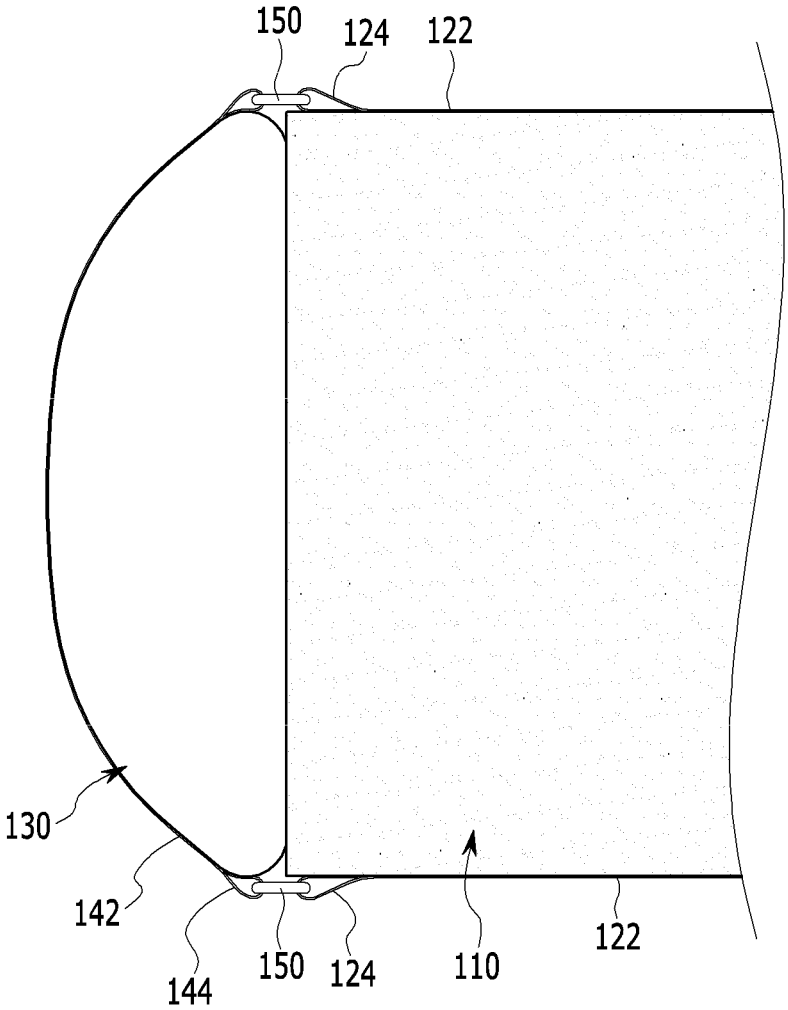
FIG. 12 is a side view illustrating a state in which the shock-absorbing block is combined with the buoyant block.

FIG. 10 is a perspective view of a shock-absorbing block and a second connection belt combined with each other in the apparatus for suppressing sloshing according to an exemplary embodiment of the present invention. FIG. 11 is a cross-sectional view of the shock-absorbing block. FIG. 12 is a side view illustrating a state in which the shock-absorbing block is combined with the buoyant block.

Referring to FIGS. 10 to 12, the shock-absorbing block 130 has a side 132 formed in various shapes and sizes corresponding to a side of the buoyant block 110, for example, in a square shape and the other side 133 opposite to the side protrudes to a side, to the left in FIG. 11.

The outer surface of the shock-absorbing block 130 is covered with a second cover 136. The second cover 136 may be made of the same material as that of the first cover 116 of the buoyant block 110.

A second foam member 134 composed of a plurality of particles is positioned in the second cover 136. The plurality of particles may mean spheres or polyhedrons having a size of about 1 cm to 20 cm in an exemplary embodiment of the present invention.

However, the second foam member 134 that can be formed in the second cover and form the shock-absorbing block 130 is not limited in size and shape and has only to be a fragmentary member that is a small piece of a foam member having the width of one side of about 1 m to 1.5 m and can be positioned in the second cover 136.

The second foam member 134 may be formed in a single unit having a shape and a size which can be positioned in the second cover 136 forming the outer surface of the shock-absorbing member 130.

Meanwhile, according to an exemplary embodiment of the present invention, second connection belts 138 are disposed on the other side of the shock-absorbing block 130. The second connection belts 138 are vertically arranged at the center on the other side of the shock-absorbing block 130, as can be seen from FIG. 10. However, the second connection belts 138 are not limited thereto and may be arranged across the other side of the shock-absorbing member 130, when the shock-absorbing block 130 is disposed on the buoyant block 110.

In this configuration, specific connection belts (not illustrated) and connection rings (not illustrated) may be disposed at one of the edges of the buoyant block 110 and fastened to the second connection belts of the shock-absorbing block 130 disposed on the buoyant block 110, by specific fastening members (not illustrated).

The second connection belts 138 may be a pair of unit belts and second connection rings 139 are formed at both ends of each of the second connection belts 138, close to the top and bottom edges of the shock-absorbing block 130.

The configurations of the second connection belts 138 and the second connection rings 139 may be similar to the configurations of the first connection belts 122 and the first connection rings 124 disposed on the buoyant block 110, and thus the detailed description is not provided.

Referring to FIG. 12, when the shock-absorbing block 130 is connected to the buoyant block 110, one side of the shock-absorbing block 130, for example, the side 132 facing the right side in FIG. 11 is brought in contact with one side of the buoyant block 110, that is, the left side of the buoyant block 110 in FIG. 12 and then the second connection rings 139 at the top and bottom edges of the shock-absorbing block 130 and the first connection rings 124 at the top and bottom edges of the buoyant block 110 are connected by the fastening members 150.

In an exemplary embodiment of the present invention, one shock-absorbing block 130 is formed to be combined with one buoyant block 110. However, when one shock-absorbing block 130 is formed large to corresponding to the sides of one or more buoyant blocks 110, it may be possible to protect the sides of a plurality of buoyant blocks 110 with one shock-absorbing block 130.

Although it is exemplified in an exemplary embodiment of the present invention that the shock-absorbing blocks 130 are coupled to the sides of the buoyant blocks 110 disposed around the apparatus for suppressing sloshing, the shock-absorbing blocks 130 may be coupled to the tops of the buoyant blocks 110. When the shock-absorbing blocks 130 are coupled to the tops of the buoyant blocks 110, it is possible to prevent the tops of the buoyant blocks 110 from being damaged by hitting against the top of the liquid cargo storage tank 1. Further, it is possible to prevent the liquid cargo storage tank 1 from being damaged by the fastening members 130 connecting adjacent buoyant blocks 110.

Figure 13:
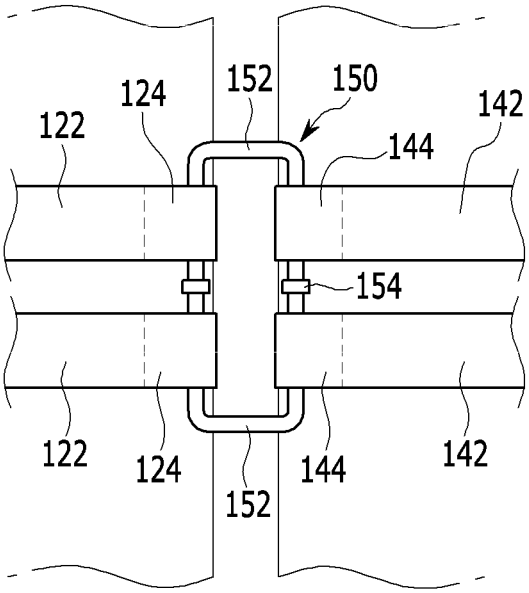
FIG. 13 is a view illustrating a state in which a fastening member of the apparatus for suppressing sloshing according to an exemplary embodiment of the present invention is combined with a pair of first connection belts.

FIG. 13 is a view illustrating a state in which a fastening member of the apparatus for suppressing sloshing according to an exemplary embodiment of the present invention is combined with a pair of facing first connection belts.

The fastening member 150, as illustrated in FIGS. 3 and 13, can connect a pair of adjacent connection rings 124 and 144 or a pair of adjacent first and second connection rings 124 and 139 so that adjacent buoyant blocks 110 or, the buoyant block 110 and the shock-absorbing block 130 are connected.

The fastening member 150, as illustrated in FIG. 13, may be composed of a pair of unit fastening members 152 symmetrically arranged.

That is, the fastening member 150 as illustrated in FIG. 13, may be composed of a pair of unit fastening members 152 bending such that both ends can be inserted in a pair of adjacent first connection rings 124 and 144 and the pair of unit fastening members 152 can be coupled to each other with both ends opposite each other by coupling members 154 such as nuts.

In more detail, the pair of unit fastening members 152 may have a U-shape, as illustrated in FIG. 13, and both ends of the pair of unit fastening members 152 can be inserted downward and upward respectively, in FIG. 13, into the pair of first connection rings 124 and 144, facing each other.

Both ends of the pair of unit fastening members 152 inserted in the pair of first connection rings 124 and 144, as illustrated in FIG. 13, may be positioned in the space between the pair of first connection belts 122 and 142 and the pair of unit fastening members 152 can be easily coupled by the coupling members 154 such as nuts in the space.

Further, according to an exemplary embodiment of the present invention, a cover member may be disposed on the fastening member 150 to prevent the fastening member from coming in contact with the inside of the liquid cargo storage tank.

Figure 14:
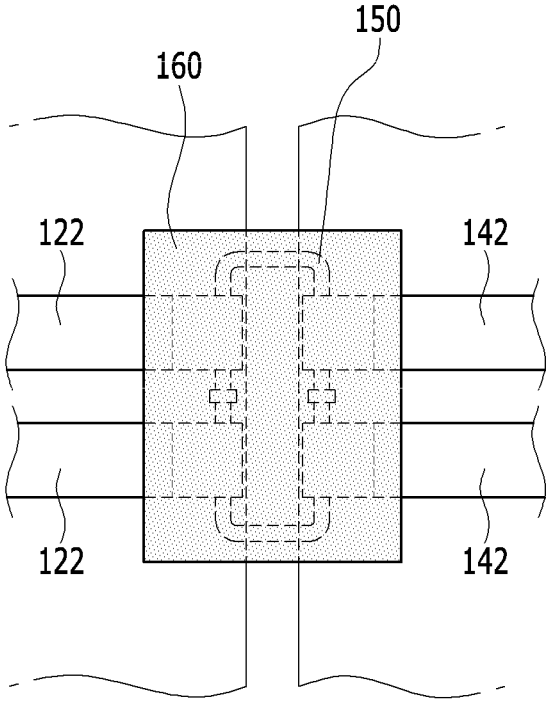
FIG. 14 is a top plan view illustrating a state in which a cover member is installed on the fastening member of the apparatus for suppressing sloshing according to an exemplary embodiment of the present invention.

FIG. 14 is a top plan view illustrating a state in which a cover member 160 is installed on the fastening member 150 of the apparatus 10 for suppressing sloshing according to an exemplary embodiment of the present invention.

The cover member 160 can cover the fastening member 150 to prevent contact between the fastening member 150 and the liquid cargo storage tank 1, as illustrated in FIG. 14.

The fastening member 150 may be made of aluminum or SUS, and other composite materials to be available at a very low temperature, so that it is possible to prevent the fastening member 150 from damaging the liquid cargo storage tank 1 by hitting against the inner wall of the liquid cargo storage tank 1 due to shaking of the apparatus 10 for suppressing sloshing by disposing the cover member 160 on the fastening member 150.

On the other hand, although a pair of U-shaped fastening members are exemplified as fastening members for connecting a buoyant block with a buoyant block or a buoyant block with a shock-absorbing block in an exemplary embodiment of the present invention, the fastening members are not limited thereto, and for example, the fastening belts may be connected by ring-shaped connecting members formed in the shape of a key ring, or buoyant blocks or shock-absorbing blocks may be connected by connecting members made of the same material as that of the belts.

Various modified examples of the fastening member are described hereafter with different figures.

Figure 15:
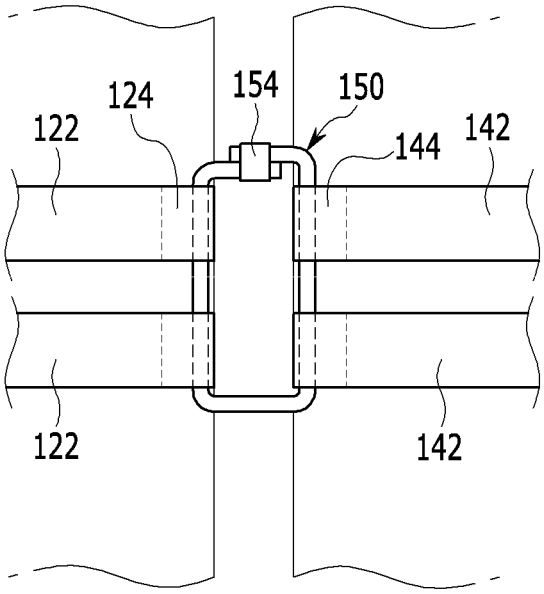
FIG. 15 is a top plan view illustrating a modified example of the fastening member of the apparatus for suppressing sloshing according to an exemplary embodiment of the present invention.

FIG. 15 is a top plan view illustrating a modified example of the fastening member 150 of the apparatus 10 for suppressing sloshing according to an exemplary embodiment of the present invention.

As illustrated in FIG. 15, the fastening member 150 may be a rope connecting a pair of adjacent first connection rings 124 and 144 while passing through the pair of adjacent first connection rings 124 and 144. That is, the fastening member 150 can connect the pair of adjacent first connection rings 124 and 144 by coupling both ends with connecting member 154 after passing through the pair of adjacent first connection rings 124 and 144. Further, any one or more of the rope and the connecting member 154 may be made of polyarylate fiber, the same as the first connection belts 122 and 142.

Using a rope made of the same material as that of the first connection belts 122 and 142 as the fastening member 150 makes it possible to preclude the fastening member 150 from damaging the liquid cargo storage tank 1 even without a specific cover member, when the fastening member 150 hits against the inner wall of the liquid cargo storage tank 1 due to shaking of the apparatus 10 for suppressing sloshing.

Figure 16:
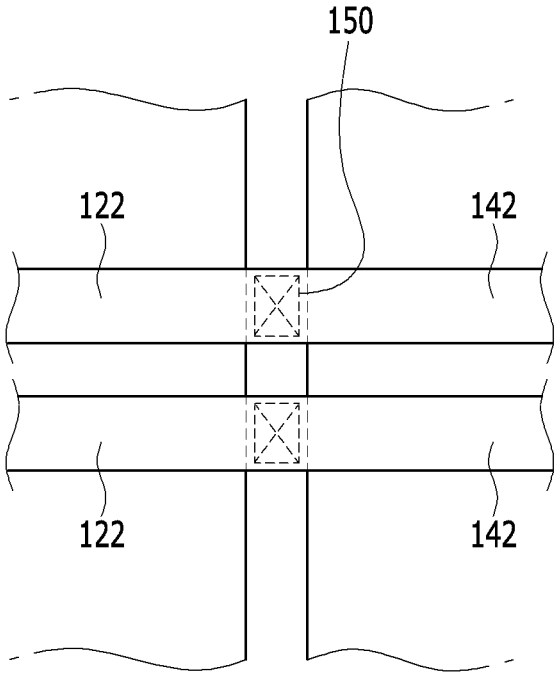
FIG. 16 is a top plan view illustrating a modified example of the connection belt and the fastening member of the apparatus for suppressing sloshing according to an exemplary embodiment of the present invention.

FIG. 16 is a top plan view illustrating another modified example of the first connection belts 122 and 142 and the fastening member 150 of the apparatus 10 for suppressing sloshing according to an exemplary embodiment of the present invention.

As illustrated in FIG. 16, the fastening member 150 may be a thread connecting the ends of a pair of adjacent first connection belts 122 and 142 by sewing with a portable sewing machine.

In this case, specific connection rings are not formed at both ends of the pair of first connection belts 122 and 142, instead, both ends of the pair of first connection belts 122 and 142 may protrude outward from the buoyant block 110. The ends of the connection belts 122 and 142, which extend outward from the buoyant block 110, as described above, can be connected to each other by the fastening member 150 such as a thread in accordance with the way of sewing, after overlapping each other.

As described above, since both ends of the pair of first connection belts 122 and 142 are connected by sewing with a thread, both ends of the pair of first connection belts 122 and 142 can be simply connected.

Figure 17:
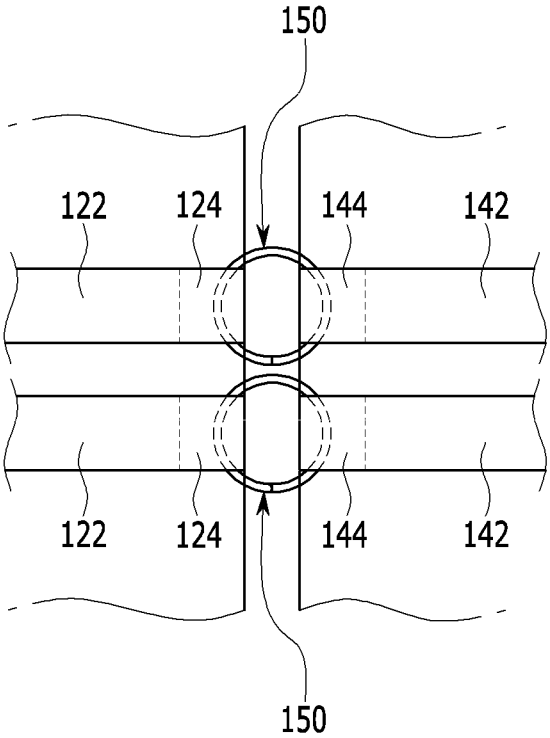
FIG. 17 is a top plan view illustrating another modified example of the fastening member of the apparatus for suppressing sloshing according to an exemplary embodiment of the present invention.
Figure 18:
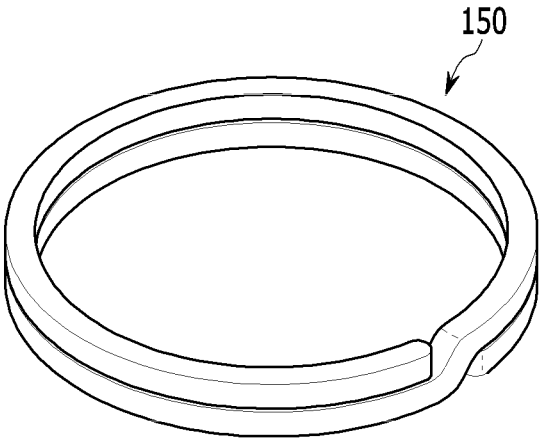
FIGS. 18 and 19 are a perspective view and a side view of the fastening member illustrated in FIG. 17.
Figure 19:
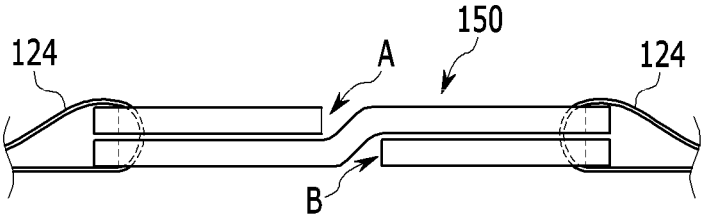

FIG. 17 is a top plan view illustrating another modified example of the fastening member of the apparatus for suppressing sloshing according to an exemplary embodiment of the present invention. FIGS. 18 and 19 are a perspective view and a side view of the fastening member illustrated in FIG. 17.

Referring to FIG. 17, the fastening member 150 may be formed in the shape of a ring. In more detail, the fastening member 150 may be formed in the shape of a key ring composed of two overlapping rings, as can be seen from FIGS. 18 and 19.

The ring like a key ring may be provided in a pair to connect the pair of first connection belts 122 and 142.

According to the ring-shaped fastening member 150 like a key ring illustrated in FIG. 17, the first connection rings 124 and 144 can be coupled to the ring-shaped fastening member 150 by inserting the first connection rings 124 and 144 of the first connection belt 122 and 142 into the gap indicated by the arrow A in FIG. 19 and then putting out the first connection rings 124 and 144 from the gap indicated by the arrow B. By coupling the first connection rings 124 and 144 to the ring-shaped fastening member 150, the first connection rings 124 and 144 can be connected without a specific connecting member.

Figure 20:
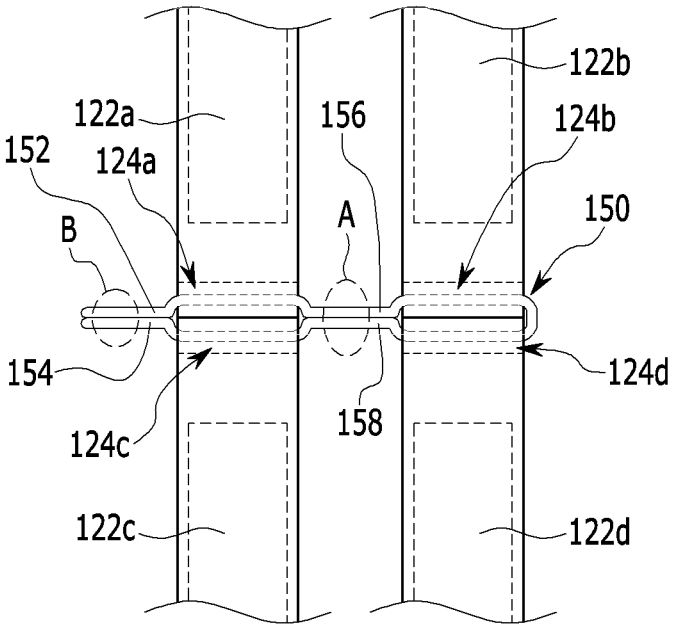
FIG. 20 is a top plan view illustrating another modified example of the fastening member of the apparatus for suppressing sloshing according to an exemplary embodiment of the present invention.
Figure 21:
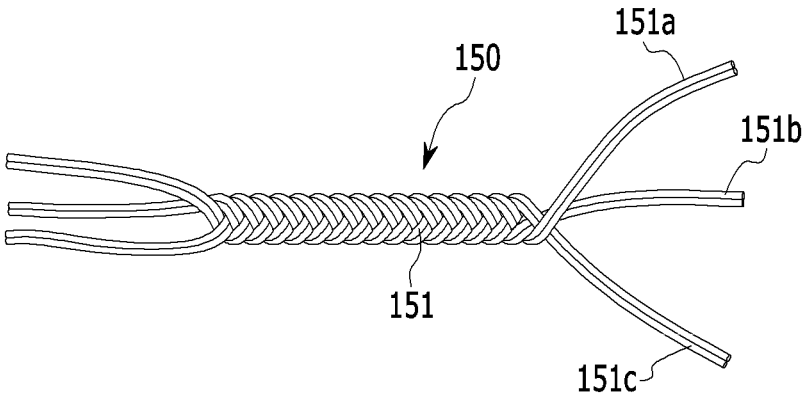
FIG. 21 is a detailed perspective view of the fastening member illustrated in FIG. 20.
Figure 22:
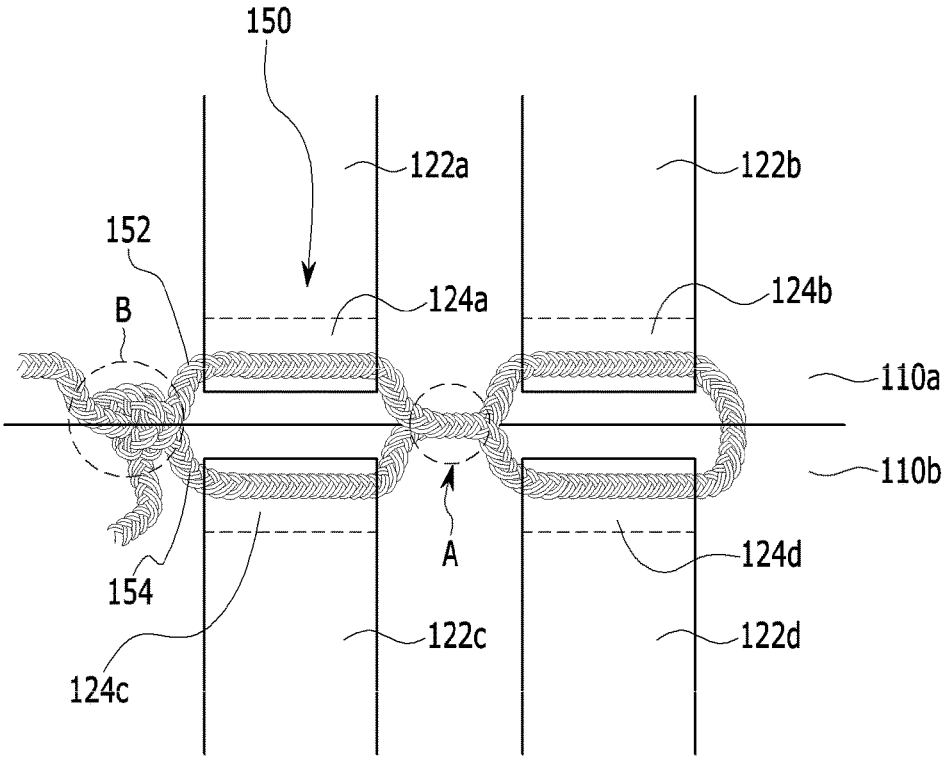
FIG. 22 is a top plan view illustrating a state in which the connection belts are combined by the fastening member illustrated in FIG. 21.
Figure 23:
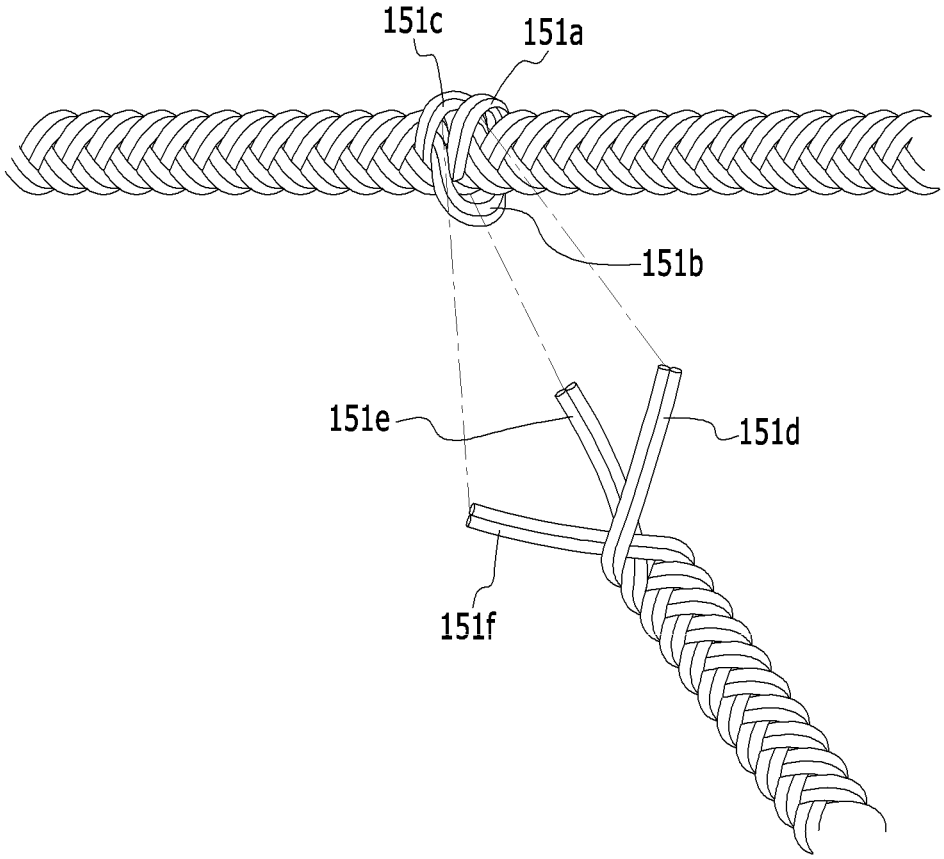
FIG. 23 is a view illustrating a state in which the fastening members illustrated in FIG. 21 are combined with each other.

FIG. 20 is a top plan view illustrating another modified example of the fastening member of the apparatus for suppressing sloshing according to an exemplary embodiment of the present invention. FIG. 21 is a detailed perspective view of the fastening member illustrated in FIG. 20. FIG. 22 is a top plan view illustrating a state in which the connection belts are combined by the fastening member illustrated in FIG. 21. FIG. 23 is a view illustrating a state in which the fastening members illustrated in FIG. 21 are combined with each other.

Referring to FIGS. 20 to 23, in the apparatus for suppressing sloshing according to an exemplary embodiment of the present invention, the fastening member 150 may be a rope 151 as another modified example of the fastening member. The fastening members illustrated in FIG. 20 can be coupled at the ends or the center without a specific connecting member, unlike the fastening members illustrated in FIG. 15.

In more detail, according to an exemplary embodiment of the present invention, as illustrated in FIG. 22, a single rope 151 may be formed such that one end sequentially passes through second-row connection rings 144*a* and 144*b* (hereafter, referred to as "first connection rings"), which are formed on second-row connection belts 142*a* and 142*b* disposed on one buoyant block 110*a* and adjacent to each other, and second-row connection rings 124*a* and 124*b* (hereafter, referred to as "third connection rings"), which are formed on second-row connection belts 122*a* and 122*b* disposed on the other buoyant block 110*b* and adjacent to each other and are adjacent to each other, facing the first connecting rings 144*a* and 144*b*, and is then coupled to the other end of the rope 151 at the area B of FIG. 22, that is, at the sides of the first and third connection rings 144*a*, 144*b*,

124*a*, and 124*b*. The end and other end of the rope 151 may be fastened by tying. However, the coupling way of the rope 151 is not limited thereto.

Further, according to another exemplary embodiment of the present invention, a portion 156 of the rope which passes through the area A of FIG. 20, that is, between the second-row connection rings 144*a* and 144*b* and the other portion 156 of the rope which passes through between the third connection rings 124*a* and 124*b* may be coupled between the second-row first and third connection rings 144*a*, 144*b*, 124*a*, and 124*b*. The way of coupling the portion and the other portion of the rope 151 is described in detail below.

As described above, since the portion 156 and the other portion 158 of the rope 151 are coupled between the second-row first and third connection rings 144*a*, 144*b*, 124*a*, and 124*b*, the first connection rings 144*a* and 144*b* and the third connection rings 124*a* and 124*b* which face each other can be firmly coupled without opening.

Further, according to an exemplary embodiment of the present invention, as illustrated in FIG. 21, the rope 151 may be formed by braiding a plurality of pieces 151*a*, 151*b*, and 151*c*. As illustrated in FIG. 21, the rope 151 used as the fastening member of the apparatus for suppressing sloshing according to an exemplary embodiment of the present invention may have high strength and flexibility by alternately braiding the pieces of threads 151*a*, 151*b*, and 151*c*.

As illustrated in FIG. 21, a single rope 151 is formed by braiding a plurality of pieces 151*a*, 151*b*, and 151*c*, the rope is formed by braiding a plurality of pieces (hereafter, referred to as "a plurality of first pieces") between the second-row first connecting rings 144*a* and 144*b* with a plurality of pieces (hereafter, referred to as "a plurality of second pieces") between the second-row third connection rings 124*a* and 124*b*.

Braiding of the first pieces and the second pieces can be achieved by alternately repeating the processes of passing the second pieces 151*d*, 151*e*, and 151*f* into the gaps between the first pieces 151*a*, 151*b*, and 151*c*, as illustrated in FIG. 23.

Accordingly, referring to FIG. 22, when the second-row first connection rings 144*a* and 144*b* and the adjacent second-row third connection rings 124*a* and 124*b* are connected by the rope 151 composed of a plurality of pieces, the rope 151 is made pass through the second-row first connection rings 144*a* and 144*b* at the upper portion in FIG. 22 first, and then made pass through the third connection ring 124*b* at the lower right side in FIG. 22.

Thereafter, the second pieces of the rope 151 are made pass through between the first pieces of the rope 151 at the area A between the second-row first connecting rings 144*a* and 144*b* and the second-row third connection rings 124*a* and 124*b*, so that the first pieces and the second pieces of the rope 151 are integrally formed.

Thereafter, the second pieces of the rope 151 which passed through the first pieces are braided again so that a single rope passes through the left connection ring 124*a*, and both ends of the rope 151 are tied at the sides of the first connection rings 144*a* and 144*b* and the third connection rings 124*a* and 124*b*, thereby fastening the rope 151 to the first and third connection rings 144*a*, 144*b*, 124*a*, and 124*b*.

As another way of fastening the rope to the connection rings, one end of the rope 151 is made pass through the first connection ring 144*b* and the other end is made pass through the opposite the third connection ring 124*b*, a single piece is formed by braiding the pieces of one end and the other end of the rope 151, before one end and the other end of the rope 151 pass through the other first connection ring 144*a* and the other third connection ring 124*a*.

Thereafter, one end and the other end of the rope are divided again into two pieces and made pass through the other first connection ring 144*a* and the other third connection ring 124*a* in the second-rows, and then one end and the other end of the rope which passed through the other first connection ring 144*a* and the other third connection ring 124*a* in the two rows are tied at the sides of the first and third connection rings, so that the rope can be fastened to the connection rings.

According to this configuration, the rope 151 can be firmly fastened to the first and third connection rings 144*a*, 144*b*, 124*a*, and 124*b* without moving in the first and third connection rings 144*a*, 144*b*, 124*a*, and 124*b*, and thus, friction between the connection belts and the rope can be minimized.

When the first connection rings and the third connection rings are coupled by the single rope 151 formed by braiding a plurality of pieces, the work is easy and the rope can be easily repaired and replaced, when being damaged.

When the rope 151 composed of threads made of the same material as that of the connection belts is used as the fastening member for connecting the buoyant blocks of the apparatus for suppressing sloshing according to an exemplary embodiment of the present invention, the rope can firmly couple the connection belts while keeping flexible at a very low temperature, so that the apparatus for suppressing sloshing can keep stable. Further, it is possible to prevent the inner wall of the liquid cargo storage tank from being damaged, even if the apparatus for suppressing sloshing hits against the inner wall of the liquid cargo storage tank.

Although adjacent connection rings are coupled by one rope in the apparatus for suppressing sloshing according to the present exemplary embodiment, the connection rings may be coupled by two or more ropes.

Further, in an exemplary embodiment of the present invention, although a way of fastening one or two ropes to the center portion (area A in FIG. 20) of the connection rings or at the ends portion (area B in FIG. 20) of the ropes was not described, various ways known in the art may be used.

Further, in an exemplary embodiment of the present invention, an entirely 8-shaped ring was formed by braiding a plurality of pieces at the center portion (area A) of the connection rings, when fastening a single rope composed of a plurality of pieces to the connection rings, other ways than the way described in this specification, for example, the way of fastening ropes with a specific fastening member may be used in order to fasten ropes at the center portion of the connection rings.

Figure 24:
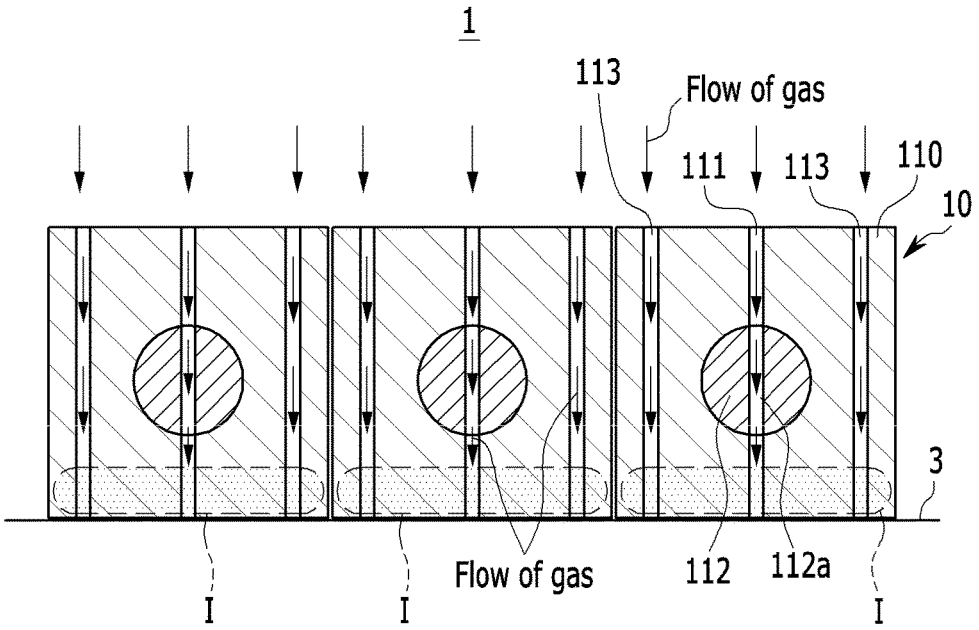
FIG. 24 is a view illustrating a state in which the apparatus for suppressing sloshing according an exemplary embodiment of the present invention on the bottom of a liquid cargo storage tank injects a gas into the liquid cargo storage tank.

FIG. 24 is a view illustrating a state in which the apparatus for suppressing sloshing according an exemplary embodiment of the present invention on the bottom of a liquid cargo tank injects a gas into the liquid cargo tank. For making the drawing simple, the connection belts and the fastening members that connect the buoyant blocks are not illustrated in FIG. 24.

Referring to FIG. 24, when a liquefied natural gas at a very low temperature is taken out of the liquid cargo storage tank 1, most of the liquefied natural gas is taken out by a pump in the liquid cargo storage tank 1 and a little amount of liquefied natural gas remains on the bottom 3 of the liquid cargo storage tank.

When the apparatus 10 for suppressing sloshing according to an exemplary embodiment of the present invention is disposed in the liquid cargo storage tank, the apparatus 10 for suppressing sloshing is placed on the bottom of the liquid cargo storage tank and the liquefied natural gas not discharged to the outside still remains at the lower side portion I of the buoyant blocks 110, under the foam member of the apparatus 10 for suppressing sloshing by the gravity.

As described above, with the apparatus 10 for suppressing sloshing placed on the bottom 3 of the liquid cargo storage tank 1, a high-temperature gas for evaporating the liquefied natural gas is injected into the liquid cargo storage tank 1, downward from the upper portion of the storage tank 1 toward the bottom 3 of the liquid cargo storage tank.

Evaporation of the liquefied natural gas remaining in the storage tank at a very low temperature is accelerated by the injected high-temperature gas.

According to an exemplary embodiment of the present invention, the high-temperature gas flows downward from the upper portion of the storage tank, with the flow of gas indicated by the arrows as described in FIG. 24, and keeps flowing into buoyant blocks 110 of the apparatus 10 for suppressing sloshing, such that the gas transmits heat even to the bottoms of the buoyant blocks 110 through the foam members of the buoyant blocks 110.

The heat of the gas passing through the buoyant block 110 transfers even to the bottom of the buoyant block 110 by heat conduction of the foam member, and according to an exemplary embodiment of the present invention, since through-holes are formed in the first foam member 114 and the buoyant body 112, heat can transfer from the top to the bottom of the buoyant block 110 by convection while the gas passes through the through-holes 111, 113, and 112*a* of the first foam member 114 and the buoyant body 112.

Therefore, according to an exemplary embodiment of the present invention, as compared with when there is no through-hole formed in the first foam member 114 and the buoyant body 112, heat can more easily transfer from the top of the buoyant block 110 to the bottom of the buoyant block 110, because through-holes are formed in the first foam member 114 and the buoyant body 112.

For more easy vertical heat transfer in the buoyant block 110, it is preferable to vertically arrange the through-holes 111, 113, and 112*a* of the first foam member 114 and the buoyant body 112 in the buoyant block 110.

Further, according to another exemplary embodiment of the present invention, since the through-holes 212, 213, 232, and 233 (see FIGS. 8 and 9) are formed in the x direction and the y direction in the first foam member and the buoyant body, when the buoyant blocks are connected, the heat of the gas can transfer horizontally, that is, in the x direction and the y directionDeletedTextsthrough the through-holes 212, 213, 232, and 233.

Accordingly, horizontal heat transfer in the buoyant block 110 can be more easily made.

As described above, not only when removing a liquid cargo from the liquid cargo storage tank 1, but also when cooling in advance the inside of the liquid cargo storage tank 1 without a liquid cargo to store the liquid cargo in the liquid cargo storage tank, the liquid cargo storage tank equipped with the apparatus for suppressing sloshing which has foam members and buoyant bodies according to an exemplary embodiment of the present invention can more quickly transmit heat to the inside of the liquid cargo storage tank, when a cooling gas is injected downward from the upper portion of the liquid cargo storage tank.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

According to an exemplary embodiment of the present invention, since shock-absorbing blocks that can be detachably combined with the buoyant blocks of the apparatus for suppressing sloshing are provided, so it is possible prevent damage to the buoyant blocks of the apparatus for suppressing sloshing.

According to an exemplary embodiment of the present invention, it is possible to easily replace the shock-absorbing blocks mounted on the apparatus for suppressing sloshing, so the apparatus for suppressing sloshing can be easily maintained.

According to an exemplary embodiment of the present invention, it is possible to prevent the liquid cargo storage tank from being damaged due to hitting of the liquid cargo storage tank and the buoyant blocks of the apparatus for suppressing sloshing.

The apparatus for suppressing sloshing according to an exemplary embodiment of the present invention allows the bottom of the liquid cargo storage tank to be rapidly cooled or heated, when the inside of the liquid cargo storage tank is cooled or heated.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

The invention claimed is:

1. An apparatus for suppressing sloshing that includes a plurality of buoyant blocks and connecting members connecting the plurality of buoyant blocks and can float on a liquid cargo in a liquid cargo storage tank, wherein a buoyant block of the plurality of buoyant blocks includes:

a buoyant body having buoyancy to float on liquid;

a first foam member covering the buoyant body and absorbing the liquid; and a first cover covering the first foam member, wherein each of the connecting members includes:

a pair of first connection belts disposed on the buoyant block, across a surface of the buoyant block, and passing centers of a top and a bottom of the buoyant block; and a fastening member connecting adjacent first connection belts respectively disposed on the buoyant block and another buoyant block adjacent to the buoyant block, and wherein first through-holes are formed through the first foam member, in a z direction which is a vertical direction perpendicular to a bottom of the liquid cargo storage tank, the first through-holes extending over a whole length of the first foam member, a second through-hole is formed through the buoyant body in the z direction, the second through-holes extending over a whole length of the buoyant body, one of the first through-holes and the second through-hole are connected to each other in a line, and the second through-hole communicates with the one of the first through-holes.

2. The apparatus of claim 1, wherein:
third through-holes are formed through the first foam member, in an x direction perpendicular to the z direction, and a y direction perpendicular to the z direction and the x direction.

3. The apparatus of claim 2, wherein:
at least one or more of the first through-holes are formed,
the one of the first through-holes is formed through a center of the first foam member, and
at least one of the third through-holes are formed through the center of the first foam member.

4. The apparatus of claim 2, wherein:
fourth through-holes are formed through the buoyant body, in the x direction, and the y direction.

5. The apparatus of claim 1, wherein:
first connection rings are formed at both ends of the pair of first connection belts.

6. The apparatus of claim 5, wherein:
the fastening member includes
a pair of unit fastening members bending such that both ends are inserted in a pair of adjacent first connection rings, and
the pair of unit fastening members are coupled to each other with both ends facing each other.

7. The apparatus of claim 1, further comprising:
a cover member covering the fastening member to prevent contact between the fastening member and the liquid cargo storage tank.

8. The apparatus of claim 5, wherein:
the fastening member includes a rope passing through a pair of adjacent first connection ring and connecting the first connection rings.

9. The apparatus of claim 8, wherein:
the rope is a single rope formed by braiding a plurality of pieces.

10. The apparatus of claim 9, wherein:
one end of the single rope sequentially or alternately passes through adjacent second-row first connection rings of any one buoyant block and then passes through adjacent second-row first connection rings of another buoyant block.

11. The apparatus of claim 10, wherein:
the rope is formed such that a plurality of first pieces between the second-row first connection rings of any one buoyant block and a plurality of second pieces between the second-row first connection rings of another buoyant block are fastened to each other.

12. The apparatus of claim 1, wherein:
the fastening member includes a thread connecting ends of a pair of adjacent first connection belt by sewing.

13. The apparatus of claim 5, wherein:
the fastening member is formed in the shape of a circular ring.

14. The apparatus of claim 1, wherein:
the buoyant is a structure containing a gas or is made of a foam material having a closed cell structure.

15. The apparatus of claim 1, wherein:
in at least one buoyant block of the plurality of buoyant blocks each having a side facing the inner wall of the liquid cargo storage tank,
a shock-absorbing block is coupled to the side facing the inner wall of the liquid cargo storage tank.

16. The apparatus of claim 15, wherein:
the shock-absorbing block includes
a second foam member that absorbs the liquid, and
a second connection belt fastened to the second foam member so that the second foam member is coupled to a side of the buoyant block by the fastening member.

17. The apparatus of claim 16, wherein:
the shock-absorbing block further includes
a second cover covering the second foam member, and
the second connection belt is fastened to the second cover.

18. The apparatus of claim 16, wherein:
the second foam member is formed by filling the second cover with a foam member composed of a plurality of particles or by covering a foam member that is a single unit with the second cover.

19. The apparatus of claim 1, wherein:
the pair of first connection belts disposed on the buoyant block cross each other at the centers of the top and the bottom of the buoyant block.

* * * * *